United States Patent [19]

Tuji

[11] 4,272,749

[45] Jun. 9, 1981

[54] REACTOR CORE OF INSULATED IRON POWDER

[75] Inventor: Toshihiko Tuji, Tokyo, Japan

[73] Assignee: Nippon Kinzoku Co., Ltd., Tokyo, Japan

[21] Appl. No.: 71,260

[22] Filed: Aug. 30, 1979

Related U.S. Application Data

[63] Continuation of Ser. No. 821,150, Aug. 2, 1977, abandoned.

[30] Foreign Application Priority Data

Aug. 9, 1976 [JP] Japan ..... 51-94647

[51] Int. Cl.[3] ..... H01F 27/24

[52] U.S. Cl. ..... 336/233; 75/0.5 AA; 148/104; 252/62.54; 252/62.55

[58] Field of Search ..... 336/229, 233, DIG. 3, 336/DIG. 4; 148/104, 105, 31.55, 31.57; 75/0.5 AA; 252/62.51 R, 62.53, 62.54, 62.55

[56] References Cited

U.S. PATENT DOCUMENTS

| | | | |
|---|---|---|---|
| 1,292,206 | 1/1919 | Woodruff | 336/233 X |
| 1,297,126 | 3/1919 | Elmen | 336/233 X |
| 1,297,127 | 3/1919 | Elman | 336/233 X |
| 1,809,042 | 6/1931 | Kelsall | 336/233 X |
| 1,982,689 | 12/1934 | Polydoroff | 252/62.53 XR |
| 2,241,441 | 5/1941 | Bandur | 336/233 X |
| 2,844,456 | 7/1958 | Llewelyn et al. | 75/0.5 AA |
| 2,978,323 | 4/1961 | Schmeckenbecher | 252/62.51 X |
| 3,615,339 | 10/1971 | Stone et al. | 75/0.5 AA |
| 3,694,187 | 9/1972 | Llewelyn | 75/0.5 AA |
| 3,694,188 | 9/1972 | Llewelyn | 75/0.5 AA |

*Primary Examiner*—Thomas J. Kozma

[57] ABSTRACT

A reactor formed by winding a conductor on a core which is formed by using mutually insulated particles of iron powder to provide a closed magnetic path. The reactor is less in leakage flux and has its inductance value accurately held over a wide frequency range.

3 Claims, 3 Drawing Figures

REACTOR CORE OF INSULATED IRON POWDER

This is a continuation of application Ser. No. 821,150 filed Aug. 2, 1977, now abandoned.

This invention provides a reactor and in particular a reactor for removing a high frequency noise flowing from a power source into an acoustic device etc.

Recently, a reactor having a constant inductance over a wide frequency range is widely used to eliminate high frequency noises flowing from a power source into an acoustic device etc. With a conventional reactor shown in FIG. 1 an iron core 1 of, for example, I-cross-section is made of ferrite, silicon steel plate etc. and a coil 2 is formed by winding a conductor or a lead wire around the iron core. When a coil is energized, a magnetic flux $\phi$ flows from the center of the iron core 1, through an upper flange of the iron core 1, an neighboring air atmosphere and a lower flange of the iron core 2, back to the center of the iron core. That is, with the conventional reactor an air gap is arbitrarily interposed on the path of the magnetic flux and the inductance of the reactor is set by a magnetic resistance in the air gap. However, the conventional reactor produces a considerable leakage at the air gap present on the magnetic path, providing a cause for noises. Furthermore, the value of inductance is set by the length of air gap and in consequence, the error of the air gap appears as the error of inductance value.

It is accordingly an object of this invention to provide a reactor which is simple in construction and capable of reducing the leakage flux to a minimum to provide an accurate inductance value over a wide frequency range.

The feature of a reactor of this invention resides in that it is formed by winding a conductor around an iron core which is formed of mutually insulated particles of iron powder to provide a closed magnetic path. A commercially available iron powder in general is oxidized by oxygen in the air and has an oxide film on its suface which serves as insulating material. Where iron powder used in this invention is an ordinary iron powder having an oxide film on its surface, no insulation treatment is necessary. Where, however, the particles of the iron powder are not completely insulated from each other, an insulation treatment may be effected. As a method for enhancing insulation of iron powder, iron powder may be subjected to phosphate pickling or heat treatment. Alternatively, varnish, fats and oils, epoxy resin, polyester resin etc. may be added to iron powder. According to this invention use may be preferably made, of iron powder, electrolytic iron, carbonyl iron, and Armco magnetic iron. However, this invention is not restricted thereto. A most preferable insulated iron powder is electrolytic iron powder.

This invention will be further described by way of example by reference to the accompanying drawings in which.

One embodiment of this invention will be explained by referring to FIGS. 2 and 3 conjointly.

Figure 1:
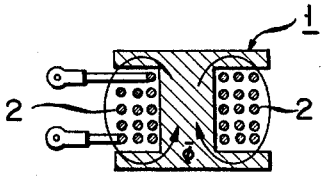
FIG. 1 PRIOR ART
FIG. 1 is a cross-sectional view showing a conventional reactor.
Figure 2:
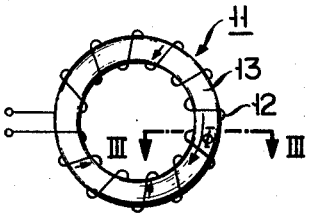
FIG. 2 is a front view showing a reactor according to one embodiment of this invention.

FIG. 2 is a front view showing a reactor. The reactor comprises an annular iron core 11 providing a closed magnetic path and a coil 12 of which a conductor is wound around the iron core 11. The iron core 11 is formed of mutually insulated particles of iron powder 14 filled in a casing 13, as shown in cross-section in FIG. 3, which is made of an insulating synthetic resin such as phenol, nylon etc. In the reactor, the iron particles are held insulated from each other, and even when a high frequency is involved no eddy-current loss is incurred and a small iron loss is involved, providing the reactor with an excellent high frequency characteristic. The reactor provides a substantially effective gap between each iron particle and the value of inductance is determined by an amount of gaps. That is, if the degree of integration i.e. the packing density is increased (the amount of gaps is small) the value of the inductance is increased and, conversely, the value of saturated current is decreased. For a small degree of integration the value of the saturated current is great and the value of inductance is small. As a practical compromise, it is preferred that the degree of integration (density) be of the order of 2 to 6.5 g/cm$^3$. The value of inductance in each frequency band is influenced by the particle size of the iron powder 14. For a coarse particle, a high inductance can be taken at the low frequency band, but since a high frequency loss is increased the value of inductance at the high frequency band is rapidly lowered when the frequency exceeds a certain value. For a fine particle, on the other hand, there is involved no drop in inductance at the high frequency band, but there is a tendency for overall inductance to be decreased owing to a decrease in effective permeability. In consequence, the particle size is selected according to the frequency band required, but in practice it will be sufficient if the inductance is constant in the frequency range of 100 to 30000 Hz. In this case, it is preferable to use an iron powder having a Tyler mesh size of 100 to 300 i.e. an iron powder passable through a 100 Tyler mesh size, but not passable through a 300 Tyler mesh size.

The reactor provides, unlike the conventional reactor, no outer void space in a magnetic path and the value of the inductance is selected by the degree of integration of the iron powder. In consequence, a magnetic flux induced when electric current passes through the coil 12 hardly leaks and no additional noise is generated due to leakage flux. Furthermore, the value of inductance can be taken with high accuracy and the value of inductance can be made constant over a low to high frequency range.

Although in the above-mentioned embodiment the iron core is formed by filling the iron powder 14 within the casing 13, this invention is not restricted thereto. For example, the iron core may be formed by using a synthetic resin as a bonding agent to provide a desired configuration.

Figure 3:
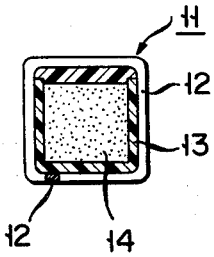
FIG. 3 is a cross-sectional view as taken along line III—III of FIG. 2.

With the reactor shown in FIGS. 2 and 3 use was made of a ring-like casing 13 made of phonol resin and having an inner diameter of 20 mm, an outer diameter of 30 mm and a height of 10 mm rectangular in cross-section. A copper wire of 0.8 in diameter was wound around a core to provide a coil of 220 turns, and a core was formed by filling into the casing 13 a 200-mesh electrolytic iron powder 14 having the degree of integration of (density) of 2.52 g/cm$^3$. Then current of 1mA was passed through the coil 12 of the reactor and the inductance was measured over a frequency range of 100 to 30000 Hz using a Maxwell's bridge. As a result, the reactor of this invention held 400 $\mu$H, which was sufficient as a reactor. The leakage flux of the reactor was measured and found to be a very small value of −40dB.

As will be appreciated from the above, according to this invention the iron core is formed free of any outer void space by using mutually insulated particles of iron powder to provide a closed magnetic path, and the value of inductance is selected by the degree of integration of the iron powder. In consequence, it is possible to prevent leakage flux as much as possible and thus prevent noise generation. It is also possible to accurately hold a given inductance value over a wide frequency band.

What is claimed is:

1. A reactor core comprising: a body made of particles of iron power providing a closed magnetic path, said particles being insulated from each other, said body having a density of from 2 to 6.5 g/cm$^3$, and said particles having a Tyler mesh size from 100 to 300.

2. A reactor core according to claim 1, comprising a casing surrounding said body.

3. A reactor core according to claim 1, wherein said particles are bonded together by a resin.

* * * * *